US008328963B2

(12) United States Patent
Takaki et al.

(10) Patent No.: US 8,328,963 B2
(45) Date of Patent: Dec. 11, 2012

(54) ALUMINUM ALLOY SHEET SUPERIOR IN PAINT BAKING HARDENABILITY AND INVULNERABLE TO ROOM TEMPERATURE AGING, AND METHOD FOR PRODUCTION THEREOF

(75) Inventors: Yasuo Takaki, Moka (JP); Kwangjin Lee, Moka (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 12/415,263

(22) Filed: Mar. 31, 2009

(65) Prior Publication Data

US 2009/0242088 A1 Oct. 1, 2009

(30) Foreign Application Priority Data

Mar. 31, 2008 (JP) ..... 2008-092891

(51) Int. Cl.
*C22C 21/08* (2006.01)
*C22F 1/05* (2006.01)

(52) U.S. Cl. ..... 148/417; 148/693; 420/535; 420/534

(58) Field of Classification Search ..... 148/693, 148/700, 417; 420/534, 535
See application file for complete search history.

(56) References Cited

U.S. PATENT DOCUMENTS

| | | | | |
|---|---|---|---|---|
| 5,662,750 | A * | 9/1997 | Shen | 148/690 |
| 6,231,809 | B1 | 5/2001 | Matsumoto et al. | |
| 7,029,543 | B2 * | 4/2006 | Bull et al. | 148/552 |

FOREIGN PATENT DOCUMENTS

| | | |
|---|---|---|
| EP | 0 480 402 A1 | 4/1992 |
| JP | 4-147951 | 5/1992 |
| JP | 6-17208 | 1/1994 |
| JP | 7-18390 | 1/1995 |
| JP | 2000-160310 | 6/2000 |
| JP | 2007-262484 | 10/2007 |

* cited by examiner

*Primary Examiner* — Roy King
*Assistant Examiner* — Janelle Morillo
(74) *Attorney, Agent, or Firm* — Oblon, Spivak, McClelland, Maier & Neustadt, L.L.P.

(57) ABSTRACT

An aluminum alloy sheet of specific Al—Mg—Si composition, which, owing to preliminary aging treatment under adequate conditions, has a specific metallographic structure in which there are a large number of clusters of specific size (each being an aggregate of atoms) expressed in terms of number density, which, when observed under a transmission electron microscope of 1,000,000 magnifications, appear as dark contrast in the bright field image. It is superior in paint baking hardenability and is invulnerable to room temperature aging during storage for a comparatively long period of 1 to 4 months.

9 Claims, No Drawings

ALUMINUM ALLOY SHEET SUPERIOR IN PAINT BAKING HARDENABILITY AND INVULNERABLE TO ROOM TEMPERATURE AGING, AND METHOD FOR PRODUCTION THEREOF

BACKGROUND OF THE INVENTION

Field of the Invention

The present invention relates to an aluminum alloy sheet which is superior in paint baking hardenability and invulnerable to room temperature aging, and also to a method for production thereof. (Aluminum may occasionally be abbreviated as Al hereinafter.) The term "aluminum alloy sheet" as used in the present invention denotes a formable blank sheet which has undergone refining (such as solid solution treatment and quenching) after rolling and is ready for fabrication into automotive body panels by press forming or the like.

6000-series aluminum alloy sheets have the advantage of exhibiting good BH performance, artificial age hardening, and paint baking hardenability. On the other hand, they have the disadvantage of being vulnerable to room temperature aging which leads to increased strength during storage at room temperature for several months after solid solution treatment and quenching. The increased strength adversely affects fabrication into automotive body panels, particularly that by bending. 6000-series aluminum alloy stock sheets are usually left for 1 to 4 months at room temperature before they are formed into automotive body panels by an automaker after they have undergone solid solution treatment in the manufacturing process at an aluminum maker. During this period, they undergo age hardening (or room temperature aging). The problem with this age hardening is that stock sheets remain readily formable into sharply bent outer panels after storage for 1 month that follows production but they become to suffer cracking at the time of hemming after storage for 3 months. Therefore, 6000-series aluminum alloy stock sheets for automotive panels (particularly outer panels) are required to remain invulnerable to room temperature aging over a comparatively long period, say about 1 to 4 months.

Moreover, aluminum alloy sheets suffering marked room temperature aging are poor in BH performance and hence they do not increase in yield strength to an extent necessary for automotive body panels even when heated for artificial aging treatment at a comparatively low temperature, such as baking of coating on formed automotive body panels.

In order to address this problem, several ideas have been proposed to make 6000-series aluminum alloy more sensitive to hardening by paint baking and less vulnerable to room temperature aging. For example, there is disclosed in Japanese Patent Laid-open No. 2000-160310 an idea that the aluminum alloy is cooled at a gradually changing cooling rate at the time of solid solution treatment and quenching, so that it does not change in strength while it is stored for 7 to 90 days at room temperature after production. There is disclosed also in Japanese Patent Laid-open No. Hei-4-147951 an idea that the aluminum alloy sheet is kept at 50-150° C. for 10-300 minutes within 60 minutes after solid solution treatment and quenching so that it acquires paint baking hardenability and shape fixability effect.

There is disclosed also in Japanese Patent Laid-open No. Hei-6-17208 an idea that the aluminum alloy sheet is cooled to a specific temperature in the first stage of cooling and cooled at a specific cooling rate in the subsequent stage of cooling at the time of solid solution treatment and quenching, so that it acquires paint baking hardenability and shape fixability effect. There is disclosed also in Japanese Patent Laid-open No. Hei-7-18390 an idea that the aluminum alloy sheet undergoes heat treatment at 100-150° C. for 0.5-5 hours after solid solution treatment and quenching, which is intended to restrict the ratio of intermetallic compound to 0.01-0.1% (by volume), so that it improves in formability and paint baking hardenability.

The disadvantage of the idea disclosed in Japanese Patent Laid-open No. 2000-160310 is that controlling the cooling rate accurately in rapid cooling by quenching is very difficult to achieve in actual production, particularly in production with a continuous heat treatment line, and hence is not practicable for production of desired sheets. Japanese Patent Laid-open No. Hei-4-14751 merely discloses paint baking hardenability and shape fixability effect which have been attained by room temperature aging for only one month; it does not disclose whether or not the claimed effect is produced by ordinary room temperature aging for 1 to 4 months. Also, Japanese Patent Laid-open No. Hei-6-17208 merely discloses paint baking hardenability and shape fixability effect which have been attained by room temperature aging for only one month; it does not disclose whether or not the claimed effect is produced by ordinary room temperature aging for 1 to 4 months.

Japanese Patent Laid-open No. Hie-7-18390 discloses nothing about room temperature aging and it merely discloses that the volume ratio of intermetallic compounds is measured by any known image processing means. With measuring methods and conditions unknown, the disclosed idea cannot be followed up or put to practice. Moreover, the foregoing prior art technologies merely describe mechanical properties and formability in terms of Erichsen value or LDR (limiting drawing ratio) but do not mention nothing about bending formability (particularly hem formability). In fact, they are unable to prevent the aluminum alloy sheet from becoming poor in hem formability as the result of room temperature aging.

OBJECT AND SUMMARY OF THE INVENTION

The present invention was completed in view of the forgoing. It is an object of the present invention to provide an aluminum alloy sheet which is superior in paint baking hardenability and invulnerable to room temperature aging after storage for a comparatively long period, say 1 to 4 months, and to provide a method for production thereof.

The present invention to achieve the foregoing object is directed to an Al—Mg—Si aluminum alloy sheet composed of Mg: 0.4-1.0%, Si: 0.4-1.5%, Mn: 0.01-0.5%, and Cu: 0.001-1.0% (in mass %), with the remainder being aluminum and inevitable impurities, which is characterized by its metallographic structure at the center of its thickness is observed under a transmission electron microscope of 1,000,000 magnifications, the bright field image contains clusters (each being an aggregate of atoms) that appear as dark contrast images, with those clusters ranging from 1 to 5 nm in equivalent circle diameter accounting for 4000-30000/$\mu m^2$ in terms of average number density.

The aluminum alloy sheet mentioned above should preferably be one which is characterized by its metallographic structure at the center of its thickness is observed under a scanning electron microscope of 500 magnifications, there are found the Mg—Si particles which have the maximum equivalent circle diameter smaller than 15 μm, with those Mg—Si particles ranging from 2 μm to 15 μm in equivalent circle diameter accounting for 100/$mm^2$ or more in terms of average number density. In addition, the aluminum alloy sheet should preferably have an average crystal grain size smaller than 35 μm.

The aluminum alloy sheet mentioned above should preferably contain Si and Mg such that the Si/Mg ratio is greater than 1.0 (by mass).

The aluminum alloy sheet according to the present invention is produced by the steps of preparing an ingot of Al—Mg—Si aluminum alloy having the above-mentioned composition, subjecting the ingot to solution heat treatment and subsequent hot rolling, subjecting the resulting hot-rolled sheet to cold rolling, subjecting the cold-rolled sheet to solid solution treatment and subsequent quenching down to room temperature, subjecting the cooled sheet to preliminary aging treatment (which consists of reheating at 90-130° C. within 10 minutes after cooling), and subjecting the reheated sheet to heat treatment which allows the reheated sheet to cool from the reheating temperature at an average cooling rate of 0.5-5° C./hr over a period of 3 hours or longer.

The production method mentioned above should preferably be modified such that the ingot undergoes solution heat treatment for 4 hours or longer at a temperature of 500° C. or higher and the melting point or lower, the soaked ingot is cooled temporarily to room temperature at an average cooling rate of 20-100° C./hr while it is at 300° C. to 500° C., the cooled ingot is reheated up to 350-450° C. at an average heating rate of 20-100° C./hr, and the reheated ingot undergoes hot rolling at this temperature.

There have been proposed many methods for making 6000-series aluminum alloy sheets more sensitive to paint baking hardenability, but there were no methods of preventing room temperature aging, which adversely affects hem formability. Both objectives have never been achieved at the same time.

The present inventors found that the paint baking hardenability and the room temperature aging are greatly affected by clusters (each being an aggregate of atoms) in specific size which can be detected only by a high-power transmission electron microscope of 1,000,000 magnifications. They also found that such clusters occur only when the solid solution treatment is followed by heat treatment that is performed at an adequate temperature for a certain length of period under specific conditions. These findings led to the present invention.

It is known that 6000-series aluminum alloys form aggregates of Mg and Si atoms (called clusters) during their storage at room temperature or their heat treatment at 50-150° C. after their solution heat treatment and quenching. However, the clusters entirely differ in behavior (or properties) depending on whether they occur during storage at room temperature or during heat treatment at 50-150° C.

Those clusters (or Si-rich clusters) which occur during storage at room temperature prevent precipitation of GP zone or β' phase which increases strength after artificial aging or paint baking. On the other hand, those clusters (or Mg/Si clusters) which occur during heat treatment at 50-150° C. promote precipitation of GP zone or β' phase. (See Yamada et al., Metal Science Forum 2000, vols. 331-337, pp 669.) These clusters have been analyzed by measurement of differential scanning calorimetory or by 3DAP (three-dimensional atom probe).

The 6000-series aluminum alloy sheets improve in paint baking hardenability if the occurrence of such clusters is properly controlled, but they become poor in hem formability on account of room temperature aging over a comparatively long period, say 1 to 4 months. The reason for this is that the Si-rich clusters occur during storage at room temperature for a long period of time.

The present inventors found that the clusters (each being an aggregate of atoms) of specific size, which can be identified only by observation under the above-mentioned high-power transmission electron microscope of 1,000,000 magnifications, occur in competition with the above-mentioned Si-rich clusters and that the former clusters present in an adequate amount (in terns of number density) control the occurrence of Si-rich clusters and room temperature aging. They also found that the clusters of specific size promote the precipitation of GP zone or β' phase, thereby improving paint baking hardenability, even though artificial age hardening treatment is performed at a low temperature for a short time.

In this sense, the clusters of specific size which are prescribed in the present invention are equivalent in quality to the Mg/Si clusters which occur during heat treatment at 50-150° C. and promote the precipitation of GP zone and β' phase. However, even though solid solution treatment and quenching are followed by heat treatment at 50-150° C. (for preliminary aging treatment and reheating treatment), the clusters prescribed in the present invention do not occur as many as specified by the average number density in the present invention unless such heat treatment is carried out under adequate conditions. This is a probable reason why cluster control in the conventional way was unable to improve paint baking hardenability and to prevent room temperature aging (particularly decrease in hem formability) at the same time.

Conventional analysis of clusters by measurement of differential scanning calorimetory or by 3DAP merely proved the presence of clusters by observation but was unable to definitely determine (or merely able to vaguely determine) the size and number density as prescribed in the present invention. Therefore, nothing has been known about how the clusters defined in the present invention improve paint baking hardenability and suppress room temperature aging. Thus, it was difficult to establish or predict adequate forming conditions. This is a probable reason why cluster control in the conventional way was unable to improve paint baking hardenability and to prevent room temperature aging (particularly decrease in hem formability) at the same time.

Unlike the conventional technologies mentioned above, the present invention employs the high-power transmission electron microscope of 1,000,000 magnifications to investigate how the clusters prescribed in the present invention produce the above-mentioned effects and how to establish the critical and adequate forming conditions.

The present invention is intended for an Al—Mg—Si aluminum alloy sheet of specific composition which has improved bending formability (such as hemming) as well as good paint baking hardenability. This object is achieved by causing clusters of specific size (observable only under the above-mentioned high-power transmission electron microscope of 1,000,000 magnifications) to occur previously so that they prevent the occurrence of Si-rich clusters (mentioned above) and the room temperature aging.

DESCRIPTION OF THE PREFERRED EMBODIMENTS

The following is a detailed description of embodiments for the aluminum alloy sheet according to the present invention.

(Metallographic Structure)

As mentioned above, the aluminum alloy sheet according to the present invention is one which has undergone rolling and ensuing refining (such as solid solution treatment and quenching) and is ready for press forming to be made into automotive body panels. Before press forming, the sheet may be allowed to stand at room temperature for a comparatively long period of time, say about 1 to 4 months, and during this period, it will suffer room temperature aging. For the aluminum alloy sheet to be free of room temperature aging, it should have the structure specified by the present invention after refining and before being allowed to stand at room temperature.

(Prescription of Clusters)

The Al—Mg—Si aluminum alloy sheet which has undergone refining and is ready to stand at room temperature should have the structure at the center of its thickness is observed under a transmission electron microscope of 1,000,000 magnifications, the bright field image contains clusters (each being an aggregate of atoms) that appear as dark contrast images, with those clusters ranging from 1 to 5 nm in equivalent circle diameter accounting for 4000-30000/$\mu m^2$ in terms of average number density.

Such clusters occur at the time of preliminary aging that follows the solid solution treatment and ensuing quenching (which were briefly mentioned above and will be mentioned in more detail later). They are identical with Mg/Si clusters which occur upon heating at 50-150° C. and promote precipitation of GP zone or β' phase as mentioned above but different from Si-rich clusters which occur during standing at room temperature and prevent precipitation of GP zone or β' phase as mentioned above.

These two kinds of clusters (atom aggregates) are distinguished from each other by the fact that those clusters that occur during preliminary aging that follows solid solution treatment and ensuing quenching give approximately spherical dark contrast in the bright field image of a transmission electron microscope of 1,000,000 magnifications, whereas those clusters (or Si-rich clusters) which occur during standing at room temperature do not give such contrast in observation under the same conditions. The former clusters in their growing stage in which the dark contrast is smaller than 1 nm in terms of equivalent circle diameter do not fully prevent Si-rich clusters from occurring during standing at room temperature. Clusters in such a small size are hardly observed even under a TEM of 1,000,000 magnifications. On the other hand, those clusters which give contrast larger than 5 nm in terms of equivalent circle diameter are regarded as GP zone or β' phase in view of the fact that they take on a needlelike or rodlike shape. Therefore, according to the present invention, the dark contrast of clusters should have an equivalent circle diameter in the range of 1 to 5 nm.

Clusters with a number density lower than 4000/$\mu m^2$ are insufficient to prevent the occurrence of Si-rich clusters and to suppress room temperature aging during standing at room temperature for a long period of time even though they promote precipitation of GP zone or β' phase and improve paint baking hardenability. Therefore, the aluminum alloy sheet remarkably decreases in hem formability after refining treatment and standing at room temperature for a comparatively long period of time, say 1 to 4 months. Also, clusters with a number density in excess of 30000/$\mu m^2$ cause the aluminum alloy sheet to excessively increase in yield strength and hence remarkably decrease in hem formability even within a short period (say 1 month) of standing after the refining treatment. In this state, Si-rich clusters and room temperature aging that occur during standing for a long period of time may be avoided but the decreased hem formability remains. Incidentally, the period of 1 to 4 months will be expressed as 100 days hereinafter for convenience' sake.

The clusters will not give the specified average number density even though the solid solution treatment and quenching are followed by heat treatment at 50-150° C. (for preliminary aging treatment and reheating treatment) unless such heat treatment is carried out adequately. Inadequate heat treatment results in excess or insufficient clusters.

(Observation of Clusters)

According to the present invention, the clusters should be observed under a transmission electron microscope (TEM) of 1,000,000 magnifications which has a bright field image. A sample for observation is taken from the Al—Mg—Si aluminum alloy sheet which has undergone refining treatment as mentioned above, and the sample is examined for texture at the center of the thickness by observation under a TEM with 1,000,000 magnifications. The clusters (atom aggregates) specified in the present invention manifest themselves as dark contrast in the bright field.

Observation under a TEM should be performed at arbitrary ten positions selected from the center of the thickness of the sheet sample. The measurements are averaged to give the average number density as specified in the present invention. There may be an instance in which the field image for observation does not permit adequate image formation because of sample curvature. In such a case the number density should be determined in an adequate region for good image formation which is 2400 $nm^2$ or lager. The equivalent circle diameter of the dark contrast in the bright field image is a diameter of a circle equivalent to one dark contrast. This equivalent circle diameter is measured for each dark contrast in the field.

To be strict, the number density specified in the present invention should be expressed in terms of the number of clusters per unit volume because observation under a transmission electron microscope involves passage of electrons through the sample in its thickness direction. In other words, the number density should be determined by measuring the thickness (t) of the sample, calculating the volume of the sample from the thickness (t) and the area of the field image, and finally converting the number of clusters of specific size per unit area into the number per unit volume or the number density.

However, observation of structure under a TEM of 1,000,000 magnifications needs as thin a sample as possible, even though it may be prepared in the usual way. To be specific, the sample should be thinner than 0.5-1.0 μm which is ordinarily encountered in observation under a TEM of lower magnifications. Therefore, the sample inevitably becomes very thin and uniform in thickness, and it is difficult to determine the thickness (t) of the sample by the known contamination spot method or from calculations that employ interference fringes. This means that difficulties are involved in conversion into the number density per unit volume by way of the thickness (t) of the sample.

Moreover, it is considered that clusters of specific size give the contrast only in a specific part of the thin sample where the thickness is suitable for image formation. For this reason, the present invention defines the average number density as the number of clusters of specific size per unit area which is counted by observation under a TEM.

Incidentally, the contamination spot method is based on the fact that a thin sample exposed to thin electron beams from a TEM for a long time gives rise to spots (or spikes) due to contamination on its upper and lower surfaces. Contamination spots originate from minute organic matters (hydrocarbons) existing in the atmosphere (vacuum) of the TEM and on the surface of the sample because such minute organic matters collect on the surface of the sample upon irradiation with electron beams, thereby forming two conical projections having approximately the same base diameter as the diameter of the electron beam for irradiation. If the thin film is tilted through an adequate angle (θ) from its horizontal direction, the foregoing spots are observed as if they are a certain distance (L) apart in the horizontal direction. This state is photographed and the distance (L) between the spots in their horizontal direction is measured from the photograph. The thickness of the sample is calculated from the equation, $t=L/\sin\theta$. When this method is used to measure the thickness of an extremely thin sample, it is necessary to tilt the sample through a large angle so that the two spots are sufficiently apart or it is necessary to extremely reduce the diameter of spot due to contamination or the diameter of electron beams. However, this is practically difficult to achieve.

(Diameter of Crystal Grains)

The aluminum alloy sheet according to the present invention should have the metallographic structure which is characterized by clusters of specific size and fine crystal grain size so that it exhibits good formability under severe forming conditions. The size of clusters is not only one factor that determines the formability of the aluminum alloy sheet under severe hem forming conditions. The formability depends also on the crystal grain size of the structure, as proved by Examples given later. The desirable crystal grain size should be 35 μm or smaller than so that the aluminum alloy sheet has good press formability and hem forming performance.

(Mg—Si Particles)

In order for the crystal grains to be as fine as possible, it is necessary that Mg—Si particles that function as nuclei for recrystallization exist under adequate conditions. According to the present invention, of the Mg—Si particles, those which have an equivalent circle diameter in the range of 2 to 15 μm should exist such that their average number density is 100/$mm^2$ or greater. Excess and coarse Mg—Si particles cause cracking to deteriorate formability and hem forming performance. In order for the structure not to contain coarse Mg—Si particles, it is necessary that the Mg—Si particles should be 15 μm or smaller in equivalent circle diameter.

(Measurement of Mg—Si Particles)

Mg—Si particles are measured by observing under a scanning electron microscope (SEM) of 500 magnifications the structure arbitrarily selected from the center of the thickness of the sample of the Al—Mg—Si aluminum alloy sheet. To be specific, the procedure consists of taking a sample from the center of the thickness of the aluminum alloy sheet, subjecting the cross section of the sample to mechanical polishing and subsequent electrolytic polishing, observing the polished surface under the SEM, and measuring the Mg—Si particles in the field image.

The term "Mg—Si particles" used in the present invention is a general term to denote any Mg—Si particles containing both Mg and Si and other elements which are recognized as dark contrast in the bright field image of the SEM. The specified Mg—Si particles are identified by the X-ray spectrometer (EDX) for the dark contrast.

Observation of the structure is performed on more than 10 spots selected at adequate intervals in the lengthwise direction from the center of the cross section of the thickness such that the total area of the fields of view is 4 $mm^2$ or larger. The resulting measurements of number density are averaged to obtain the average number density specified in the present invention. The size of each of the Mg—Si particles is expressed in terms of equivalent circle diameter of each dark contrast. Incidentally, the average number density of Mg—Si particles observed under the SEM is counted per unit area, not per unit volume, of the cross section of the sample.

(Chemical Composition)

The 6000-series aluminum alloy sheet according to the present invention should have the chemical composition specified below, because it is used as automotive exterior panels that need good formability, BH performance, strength, weldability, and corrosion resistance.

The aluminum alloy sheet to meet such requirements should be composed of Mg: 0.4-1.0%, Si: 0.4-1.5%, Mn: 0.01-0.5% (preferably 0.01-0.15%), and Cu: 0.001-1.0% (preferably 0.01-1.0%) (in mass %), with the remainder being aluminum and inevitable impurities.

The 6000-series aluminum alloy sheet according to the present invention should preferably be that of excess-Si type, which excels in BH performance and has the Si/Mg ratio of 1 or larger (by mass). It provides a low yield strength desirable for formability at the time of press forming and bending, and it increases in yield strength due to age hardening that occurs when it undergoes artificial aging, which is heat treatment at a comparatively low temperature, encountered at the time of paint baking to be performed after it has been formed into automotive body panels. In other words, it has good bake hardening performance (BH performance) which is necessary for its desirable strength. The 6000-series aluminum alloy sheet of excess-Si type is particularly superior in BH performance to the 6000-series aluminum alloy sheet having an Si/Mg ratio smaller than 1 (by mass).

Other elements than Mg, Si, Mn, and Cu are basically impurities, and the content of each impurity should be less than specified in the AA and JIS standards. However, contamination with impurities listed below is liable to occur when the melt is prepared from not only high-purity aluminum ground metal but also scraps of 6000-series alloy and other aluminum alloys in large amounts for the purpose of recycling. Reducing these impurity elements below the detection limit increases production cost, and a certain level of their content should be allowed. Such impurities may be contained in a certain amount without adverse effect on the object and function of the present invention, and they may even produce some kind of effect.

Fe, Cr, Ti, and Zn are basically impurities in the present invention. However, each of these elements may additionally be contained in an amount less than specified as follows. Fe: 1.0% or less, Cr: 0.3% or less, Ti: 0.1% or less, and Zn: 1.0% or less.

The following is the base on which the content of each element listed above is established for the 6000-series aluminum alloy.

Si: 0.4-1.5%

Like Mg, Si is an essential element to form the foregoing clusters specified in the present invention. It also causes solution strengthening and forms age precipitates that contribute to improved strength at the time of artificial aging treatment (such as paint baking) at a comparatively low temperature. In other words, it exhibits the age hardening effect that imparts strength (or yield strength) necessary for automotive exterior panels. It is the most important element in the 6000-series aluminum alloy sheet according to the present invention; it provides the sheet with press formability and bendability for hemming.

In order that the 6000-series aluminum alloy sheet exhibits good age hardening effect by paint baking that is performed at a low temperature for a short time after it has been formed into automotive body panels, Si should be contained in such an amount that the Si/Mg ratio is 1.0 or greater (by mass). In other words, the Si content relative to the Mg content should be higher than that of the ordinary 6000-series aluminum alloy containing excess Si.

With too small a content, Si does not form as many clusters as specified by the number density mentioned above, which remarkably deteriorates paint baking hardenability. Moreover, insufficient Si is unable to impart press formability and bendability required in many applications. With an excess content, Si forms coarse precipitates which remarkably deteriorate press formability and bendability. Moreover, excess Si also detrimental to weldability. An adequate content of Si should be 0.4 to 1.5%.

Mg: 0.4-1.0%

Like Si, Mg is an essential element to form the foregoing clusters specified in the present invention. It also causes solution strengthening and forms age precipitates that contribute to improved strength at the time of artificial aging treatment (such as paint baking) at a comparatively low temperature. In other words, it exhibits the age hardening effect that imparts yield strength necessary for automotive exterior panels. With too small a content, Mg does not form as many clusters as specified by the number density mentioned above, which remarkably deteriorates paint baking hardenability. Moreover, insufficient Mg is unable to impart yield strength necessary for automotive body panels. With an excess content, Mg causes SS marks (stretcher strain marks). An adequate content of Mg should be 0.4 to 1.0%.

Cu: 0.001-1.0%

Cu promotes the formation of age precipitates that contribute to improved strength in crystal grains of the aluminum alloy structure during artificial age treatment at a comparatively low temperature for a short time as specified in the present invention. Cu in the form of solid solution also improves formability. Cu does not produce its effect if its content is less than 0.001%, especially less than 0.01%. On the other hand, Cu in excess of 1.0% greatly deteriorates resistance to stress corrosion cracking, resistance to filiform corrosion (one form of corrosion that occurs after paint coating), and weldability. An adequate content of Cu is 0.001-1.0%, preferably 0.01-1.0%.

Mn: 0.01-0.5%

Mn forms dispersed particles (dispersion phase) at the time of soaking heat treatment. Since dispersed particles prevent grain boundary migration after recrystallization, Mn produces the effect of yielding fine crystalline grains. According as crystalline grains become finer, the aluminum alloy sheet of the present invention improves in press formability and hem forming performance. Mn in an amount less than 0.01% does not produce these effects.

On the other hand, excess Mn tends to form coarse intermetallic compounds and precipitates of Al—Fe—Si—(Mn, Cr, Zr) at the time of melting and casting, thereby causing the aluminum alloy sheet to deteriorate in mechanical properties. Mn in excess of 1.0% aggravates bendability. An adequate content of Mn should be 0.02-0.5%, preferably 0.01-0.15%.

(Manufacturing Method)

The following is a description of the method for producing the aluminum alloy sheet according to the present invention. The manufacturing method, which is ordinary and known for itself, consists of preparation of an ingot by casting from a 6000-series aluminum alloy, soaking, hot rolling, cold rolling, and refining by solid solution treatment.

In the course of production, solid solution treatment and heat treatment that follows quenching should be carried out adequately so as to form the above-mentioned clusters, which suppress room temperature aging for improved bendability such as hemming and also improve paint baking hardenability. Clusters should be controlled under adequate conditions in other steps so that they meet requirements set forth by the present invention.

(Melting, Casting, and Cooling Rate)

In the melting and casting steps, the molten aluminum alloy of 6000 series having the above-mentioned composition is cast by an ordinary method such as continuous casting or semicontinuous casting (DC casting). Casting should be followed by cooling at a specific average cooling rate no smaller than 30° C./min during cooling from the melting temperature (about 700° C.) to the solidus temperature. This requirement is imposed to yield the clusters as specified in the present invention.

The average cooling rate specified above ensures rapid cooling in the high-temperature region after casting. Without rapid cooling, the ingot is liable to precipitation of coarse crystals and fluctuation in the size and amount of precipitates in the widthwise and thickness directions. This makes it impossible to control clusters and Mg—Si particles as specified in the present invention.

(Soaking Heat Treatment)

The ingot of aluminum alloy which has been cast as mentioned above subsequently undergoes soaking heat treatment prior to hot rolling. Soaking is intended to homogenize the structure, or to eliminate segregation from the crystal grains in the structure of the ingot. Soaking may be accomplished in a single stage as usual; however, soaking should be carried out under adequate conditions so as to prevent Mg—Si particles from becoming coarse and from occurring excessively (or in excess of the number density).

Consequently, the temperature of soaking should be 500° C. or higher and less than the melting point, and the duration of soaking should be longer than 4 hours. Soaking at a temperature lower than specified above does not completely eliminate segregation in crystal grains, and residual segregations cause rupture to aggravate stretch flangeability and bending formability. This soaking may be followed by hot rolling immediately or after cooling to an adequate temperature. Either way is acceptable to attain the number density of clusters as specified in the present invention.

The soaking heat treatment is followed by cooling to room temperature at an average cooling rate of 20-100° C./hr while the ingot temperature is between 300° C. to 500° C. Then, the ingot is heated again up to 350-450° C. at an average heating rate of 20-100° C./hr. Hot rolling is started at the raised temperature.

Cooling that follows soaking and reheating that follows cooling would not give rise to the Mg—Si particles as specified above if the cooling and heating rates are outside the range specified above. Excessively rapid cooling and reheating will result in a less number of fine Mg—Si particles, with the average number density being smaller than 100/mm$^2$ for Mg—Si particles having an equivalent circle diameter in the range of 2 to 15 μm. By contrast, excessively slow cooling and reheating result in coarse compounds having an equivalent circle diameter larger than 15 μm (which is the maximum value specified in the present invention).

Hot rolling consists of two steps of rough rolling and finish rolling by a rolling mill of reverse type or tandem type.

Hot rolling (rough rolling) should start at a temperature below 450° C. so that Mg—Si particles are obtained as specified in the present invention. However, hot rolling that starts at a temperature below 350° C. does not proceed smoothly. Hot rolling should start at a temperature between 350° C. to 580° C., preferably between 350° C. to 450° C.

Hot rolling may be followed by cold rolling without intermediate annealing (rough annealing). However, such annealing will provide fine crystal grains and adequate texture, thereby contributing to improvement in formability and other characteristics.

(Cold Rolling)

Cold rolling makes the hot-rolled sheet into a cold-rolled sheet (or coil) having a desirable thickness. The draft of cold rolling should preferably be lower than 60% so that fine crystal grains are obtained. Intermediate annealing may be carried out between passes of cold rolling for the same reason as rough annealing mentioned above.

Cold rolling is followed by solution quenching, which includes heating and cooling by the ordinary heat treatment line without specific restrictions. This process should be carried out by heating up to 520° C. at a heating rate greater than 5° C./sec and keeping at that temperature for 0 to 10 seconds so as to make crystal grains finer.

Heating is followed by quenching at a cooling rate of 10° C./sec or greater so as to prevent formation of coarse intergranular compounds that deteriorate formability and hem forming performance. Slow cooling causes Si and $Mg_2Si$ to precipitate on the grain boundary, and they start rupture at the time of press forming and bending, thereby aggravating formability. Quenching to ensure the desirable rapid cooling should be performed by air blowing or water spraying or dipping.

(Preliminary Aging Treatment)

The cold-rolled sheet which has undergone quenching and cooling to room temperature subsequently undergoes preliminary aging treatment (reheating treatment) within 10 minutes. This preliminary aging treatment consists of reheating to 90-130° C., cooling for 3 hours or more at an average cooling rate of 0.5-5° C./hr, and self-cooling down to room temperature. Thus there is obtained the desired structure having the number density of clusters as specified in the present invention. The foregoing conditions are essential to form as many clusters as the specified number density.

The result of leaving the rolled sheet for more than 10 minute at room temperature after quenching is that Si-rich clusters occur first to exclude the number density of clusters as specified in the present invention. This avoids the paint baking hardenability and the effect of suppressing room temperature aging. The result of reheating at a temperature lower than 90° C. is that the number density of clusters is not attained as specified in the present invention. This avoids the paint baking hardenability and the effect of suppressing room temperature aging. The result of reheating at a temperature higher than 130° C. is that clusters occur more than the number density specified in the present invention and that intermetallic compounds, such as β' phase, which are different from clusters, occur to deteriorate formability and bendability. Therefore, the temperature for the preliminary aging treatment should preferably be 100° C. to 120° C.

The preliminary aging treatment greatly affects the number density of clusters according to the reheating temperature and the retention time (or the cooling rate). The result of the retention time shorter than 3 hours at 90-130° C., preferably 100-120° C., is that the number density of clusters is not attained as specified in the present invention. This avoids the paint baking hardenability and the effect of suppressing room temperature aging. The result of excessively long retention time is that clusters occur more than the number density specified in the present invention and intermetallic compounds, such as β' phase, which are different from clusters, occur to deteriorate formability and bendability. In the case of coiled sheet, the retention time gets longer inevitably for the preliminary aging at a constant temperature in which cooling is slow. Therefore, the heat treatment should be carried out in such a way that the reheated sheet is allowed to cool slow at a cooling rate of 0.5-5° C./hr over a period of 3 hours or longer, so that the number density of clusters is attained as specified in the present invention.

No maximum retention time is set up for the preliminary aging treatment. However, as mentioned above, the result of an excessively long retention time is that clusters occur more than necessary and intermetallic compounds, such as β' phase, which are different from clusters, occur to deteriorate formability and bendability. If the temperature is higher than 120° C. after retention for 5 hours, it is desirable to cool down to 100° C. at a cooling rate of 3° C./hr or greater, preferably 5° C./hr or greater. (If the temperature is lower than 100° C. after retention for 5 hours, the cooling condition employed during retention may remain the same.) In this case, the preliminary aging treatment may be carried out in such a way that the sheet is reheated and kept hot adiabatically. In this way it is possible to obviate the necessity of controlled heating which is essential in the case where a constant temperature should be maintained.

The preliminary aging treatment does not need any specific heating rate. However, an adequate heating rate is 10° C./min or greater, preferably 50° C./min or greater, so that the desired temperature is reached within 10 minutes after solid solution treatment and quenching. Incidentally, in the case where solid solution treatment and quenching are carried out continuously, the rolled sheet may be heated again before or after coiling.

EXAMPLES

The invention will be described below in more detail with reference to the examples, which are not intended to restrict the scope thereof and will be modified and changed within the scope thereof.

Example 1

Several kinds of 6000-series aluminum alloy sheets differing in the aspect of clusters were prepared, and they were examined for paint baking hardenability and room temperature aging.

The 6000-series aluminum alloy sheets shown in Table 1 underwent sequentially soaking heat treatment, hot rolling, cold rolling, solid solution treatment, and quenching under the conditions shown in Table 2. In Table 1, any element whose content is less than the detection limit is indicated by the symbol "-".

To be specific, each aluminum alloy sheet was prepared under the following conditions. First, an ingot having the composition shown in Table 1 is prepared by DC casting. The resulting ingot is cooled at an average cooling rate of 50° C. from the melting temperature (about 700° C.) to the solidus temperature.

The ingot undergoes soaking heat treatment at 560° C. for 4 hours, which is followed by rough hot rolling and finish rolling, so as to give a hot-rolled sheet (in coil form) having a thickness of 3.5 mm. The hot-rolled aluminum alloy sheet undergoes cold rolling without intermediate annealing (rough annealing) to give a cold-rolled sheet (in coil form) having a thickness of 1.0 mm.

The cold-rolled sheet is heated to the solid solution treatment temperature (550° C.) by using a continuous heat treatment apparatus, with heating up to 500° C. at an average heating rate of 10° C./sec. Then, it immediately undergoes solid solution quenching, which is cooling to room temperature at an average cooling rate of 50° C./sec. Quenching is immediately followed by heating and cooling for preliminary aging treatment under the conditions shown in Table 2. The sheet is allowed to cool from the reheated temperature for 5 hours at an average cooling rate shown in Table 2 and then allowed to cool to room temperature.

Each sheet undergoes refining treatment. A sheet sample (or blank) is cut out of the thus finished sheet, and then it is examined for structure. The results are shown in Table 3.

(Cluster)

The texture at the center of the thickness of the sample sheet is observed under a transmission electron microscope of 1,000,000 magnifications as mentioned above. Clusters that appear as dark contrast in the bright field image are counted and the average number density per $\mu m^2$ is obtained for clusters having an equivalent circle diameter ranging from 1 to 5 nm.

(Crystal Grain Size)

The cross section (parallel to the rolling direction) at the center of the thickness of the sheet sample undergoes pretreatment by mechanical polishing and anodic oxidation (Barker method). It is then examined for texture under an optical microscope of 100 magnifications. Observation is made at arbitrary 10 points on the cross section parallel to the rolling direction according to the line intercept method (which consists of drawing straight lines in the rolling direction and the thickness direction and measuring the length of the intercept of each crystal grain on the straight line, with the intercept being regarded as the crystal grain size). The ten measurements are averaged to give the average crystal grain size. Each line for measurement is longer than 0.5 mm and there are three lines each in the rolling direction and the thickness direction in each field image. The crystal grain sizes measured for these liens are averaged, and the results obtained from ten measuring points are averaged to give the average crystal grain size.

(Characteristics of Sample Sheet)

The sample sheet, which has undergone refining treatment, is examined for room temperature aging by allowing to stand at room temperature for 7 days and 100 days. Room temperature aging is evaluated in terms of tensile strength (MPa), 0.2% yield strength (MPa), 0.2% yield strength after artificial age hardening treatment (to simulate paint baking hardening), press formability, and hem formability. The results are shown in Table 3.

(Mechanical Properties)

A test specimen, 25 mm×50 mm GL×thickness, conforming to No. 5 of JIS Z2201, is cut out of the sample sheet which has been allowed to stand at room temperature for 7 days and 100 days after refining treatment and also the sample sheet which has undergone artificial age hardening treatment (baking). The test specimen is examined for mechanical properties in terms of tensile strength. The test specimen is stretched in the direction perpendicular to the rolling direction at a rate of 5 mm/min until the yield strength is reached and 20 mm/min after that. Five measurements are made for each sample sheet and the results of measurements are averaged.

(Paint Baking Hardenability)

Artificial age hardening treatment to evaluate paint baking hardenability is carried out in the following manner. The sample sheet which has undergone refining treatment is allowed to stand at room temperature for 7 days and 100 days. Then, the sample sheet is given a preliminary strain (2%) and heated at 170° C. for 20 minutes. This heating condition is equivalent to paint baking. The heat-treated sample sheet undergoes tensile test to evaluate paint baking hardenability. Five measurements are averaged.

(Press Formability)

The sample sheet which has been allowed to stand at room temperature for 100 days after refining treatment is examined for press formability by punch stretch forming test. This test employs a spherical punch (100 mm in diameter) and a die (with beads), which are pushed against a rectangular blank (measuring 110 mm by 200 mm). Press formability is expressed in terms of the maximum height (LDH0 mm) that is formed without cracking. This test is carried out with a blank holding force of 200 kN and a forming speed of 200 mm/min. The specimen is lubricated with commercial rust-preventive cleaning oil. The test is repeated five times, and the lowest height is regarded as the critical forming height.

(Hem Formability)

The sample sheet which has been allowed to stand at room temperature for 100 days after refining treatment is examined for hem formability in the following manner. A rectangular specimen (30 mm wide) is bent 90° with an inside curvature of radius (R) of 1.0 mm by down flanging. The bent part is further bent inward, with an inner (1.0 mm thick) inserted, to about 130° (for pre-hemming) and then to 180° (for flat hemming), so that the end comes into close contact with the inner. The bent part of the flat hem is visually examined for rough surface, minute cracking, and large cracking. The results are rated as follows.

0: no cracking and no rough surface, 1: slight rough surface, 2: deep rough surface, 3: minute cracking, 4: linear continuous surface cracking, 5: rupture.

It is noted from Tables 1 to 3 that the samples A1 to A9, which accord with the present invention in composition, manufacturing condition, and refining treatment, have the specified clusters (atom aggregates whose dark contrast has an equivalent circle diameter of 1-5 nm), the specified average number density (4000-30000/$\mu m^2$), and the specified average crystal grain size (30-40 μm), which is comparatively fine.

All of these samples pertaining to the present invention show no difference in tensile strength (MPa), 0.2% yield strength (MPa), and 0.2% yield strength after artificial age hardening treatment (MPa) between those which are allowed to stand at room temperature for 100 days (for room temperature aging) after refining treatment and those which are allowed to stand at room temperature for a short period of 7 days after refining treatment. Moreover, they exhibit good press formability and hem forming performance even though they are allowed to stand at room temperature (for room temperature aging) for a long time of 100 days after refining treatment. Therefore, the samples according to the present invention are superior in paint baking hardenability, increase in yield strength due to room temperature aging, and formability (particularly hem forming performance).

By contrast, it is noted from Tables 1 to 3 that the samples A13 to A16 of Comparative Example differ from the samples of Example 1 of the present invention although there is no difference in composition. Samples A13 to A16 did not undergo preliminary aging treatment under the desirable conditions. Sample A13 underwent preliminary aging treatment at an excessively high temperature. Sample A14 underwent preliminary aging treatment with excessively rapid cooling while being held at the aging treatment temperature. Sample A15 was allowed to stand at room temperature for an excessively long period of time from quenching to preliminary aging treatment (heating). Sample A16 underwent preliminary aging treatment at an excessively low temperature.

For the reasons mentioned above, it is shown in Table 3 that sample A13 has an excessively large average density of clusters specified in the present invention and it also has intermetallic compound phase, such as β' phase, which is different from clusters, and hence is poor in formability and bendability. It is also shown in Table 3 that samples A14 to A16 have an excessively small average density of clusters specified in the present invention and hence they do not improve in paint baking hardenability, they increase in yield strength by room temperature aging, they become poor in formability, and they are poor in press formability and hem formability.

Samples A10 to A12 in Comparative Example were produced under desirable conditions, including the condition of preliminary aging treatment; however, they have the composition not conforming to the present invention. For this reason, it is shown in Table 3 that sample A10, which contains an excess amount of Si, and sample A11, which contains an excess amount of Mg, has an adequate average number density of clusters specified in the present invention, and hence they excel in paint baking hardenability and they prevent increase in yield strength and decrease in formability by room temperature aging; however, they are poor in press formability and hem formability. Sample A12, which contains an excessively small amount of Si, has an excessively small average number density of clusters specified in the present invention. This sample A12 does not increase in yield strength by room temperature aging on account of its low Si content; however, it is low in yield strength after baking and poor in press formability because it is originally poor in strength.

The foregoing results of Examples prove that the composition, structure, and manufacturing condition, which are specified in the present invention, are essential for the samples to have improved paint baking hardenability, to increase in yield strength by room temperature aging, to prevent decrease in formability, and to exhibit good mechanical properties.

Example 2

Several kinds of 6000-series aluminum alloy sheets were prepared which differ in the conditions for clusters, the average crystal grain size, and the Mg—Si particles that give rise to fine crystal grains. They were examined to see how their characteristics (such as paint baking hardenability and room temperature aging) are affected by the foregoing factors. The samples were tested for press formability and hem forming performance as in Example 1, except that the test for formability was done under more stringent conditions to simulate formation of outer panels.

A 6000-series aluminum alloy having the composition shown in Table was cast into an ingot in the same way as in Table 1. The ingot underwent soaking heat treatment, hot rolling, and cold rolling under the conditions shown in Table 4. Thus there was obtained a cold-rolled sheet, 1.0 mm thick, in coil form. The cold-rolled sheet underwent solid solution treatment and quenching by using a continuous heat treatment apparatus under the same conditions as in Example 1.

The difference from Example 1 is that the ingot which had undergone soaking heat treatment for 4 hours at the specified temperature was cooled to room temperature at an average cooling rate shown in Table 4 during cooling to 300-500° C. and subsequently heated again to the hot rolling start temperature at an average heating rate shown in Table 4. These conditions are intended to form Mg—Si particles (which reduce the average crystal grain size) and to control the average crystal grain size.

The sheet underwent solid solution heat treatment in the same way as in Example 1, which was followed by preliminary aging treatment consisting of heating and cooling under the conditions shown in Table 4. Cooling after reheating lasted for 5 hours at the cooling rate shown in Table 4, and the sheet was allowed to cool spontaneously to room temperature.

After refining treatment, the finished sheet was cut into a sample sheet (blank), which was examined for structure in the same way as in Example 1 except that analysis for Mg—Si particles was added. The results are shown in Table 5.

(Mg—Si Particles)

The cross section at the center of the thickness of the sample sheet was examined for structure by observation under a scanning electron microscope of 500 magnifications as mentioned above. Observation reveals Mg—Si particles as dark contrast in the bright field image. Mg—Si particles were examined for maximum size in terms of equivalent circle diameter (in μm) and number in terms of average number density per $mm^2$ for those which range from 2 to 15 μm in equivalent circle diameter.

(Characteristics of Sample Sheet)

The sample sheet, which had undergone refining treatment, was allowed to stand at room temperature for 7 days or 100 days (for room temperature aging) in the same way as in Example 1. The aged sample sheet was examined for characteristic properties in the same way as in Example 1, except that the test for press formability and hem forming performance was done under more stringent conditions to simulate formation of outer panels. The results are shown in Table 5.

(Press Formability)

The sample sheet which had been allowed to stand at room temperature for 100 days after refining treatment was examined for press formability by the same method and under the same condition as in Example 1, except that the forming rate was increased to 40 mm/min to reproduce the real forming condition. This test was repeated five times, and the test result was rated by regarding the lowest stretch height as the critical forming height without cracking.

(Hem Formability)

The sample sheet which had been allowed to stand at room temperature for 100 days after refining treatment was examined and rated for hem formability in the same way as in Example 1, except that the inner inserted for flat hem forming was replaced by a thinner one which has a thickness of 0.8 mm, to simulate the more stringent condition.

It is noted from Tables 1, 4, and 5 that the samples B1 to B9, which accord with the present invention in composition, manufacturing condition, and refining treatment, have the specified clusters (atom aggregates whose dark contrast has an equivalent circle diameter of 1-5 nm) and the specified average number density (4000-30000/$\mu m^2$). Owing to the specific average cooling rate for cooling from soaking temperature to room temperature and the specific heating rate for subsequent heating up to the hot rolling start temperature, they contain Mg—Si particles with the maximum equivalent circle diameter and average number density meeting requirement of the present invention. Owing to such adequate Mg—Si particles, they have the average crystal grain size of 30 μm or less, which is smaller than that in Example 1.

All of these samples B1 to B9 pertaining to the present invention show no difference in tensile strength (MPa), 0.2% yield strength (MPa), and 0.2% yield strength after artificial age hardening treatment (MPa) between those which are allowed to stand at room temperature for 100 days (for room temperature aging) after refining treatment and those which are allowed to stand at room temperature for a short period of 7 days after refining treatment. Moreover, they exhibit good press formability and hem forming performance under more stringent conditions than in Example 1 even though they are allowed to stand at room temperature (for room temperature aging) for a long time of 100 days after refining treatment. Therefore, the samples according to the present invention excel in paint baking hardenability and suppresses increase in yield strength due to room temperature aging and decrease in formability.

<0101>

By contrast, it is noted from Tables 1, 4, and 5 that the samples B13 to B18 of Comparative Example differ from the samples of Example 1 of the present invention although there is no difference in composition. They did not undergo preliminary aging treatment under the desirable conditions. Sample B13 underwent preliminary aging treatment at an excessively high temperature. Sample B14 underwent preliminary aging treatment with excessively rapid cooling while being held at the aging treatment temperature. Sample B15 was allowed to stand at room temperature for an excessively long period of time from quenching to preliminary aging treatment (heating). Sample B16 underwent preliminary aging treatment at an excessively low temperature.

For the reasons mentioned above, it is shown in Table 5 that sample B13 has an excessively large average density of clusters specified in the present invention and it also has intermetallic compound phase, such as β' phase, which is different from clusters, and hence is poor in formability and bendability. It is also shown in Table 5 that samples B14 to B16 have an excessively small average density of clusters specified in the present invention and hence they do not improve in paint baking hardenability, they increase in yield strength by room temperature aging, they become poor in formability, and they are poor in press formability and hem formability.

Sample B17 was cooled too rapidly between 300° C. and 500° C. after soaking heat treatment and was subsequently heated too rapidly up to the rolling temperature. Therefore, it has an excessively small average number density for Mg—Si particles, with the average crystal grain size being larger than 40 μm, and it is poorer in hem formability than samples B1 to B9. Sample B18 was cooled too slowly between 300° C. and 500° C. after soaking heat treatment and was subsequently heated too slowly up to the rolling temperature. Therefore, it has excessively coarse Mg—Si particles, with the maximum diameter increased. Therefore, it is poorer in strength, formability, and hem forming performance than samples B1 to B9.

Samples B10 to A12 in Comparative Example were produced under desirable conditions, including the condition of preliminary aging treatment; however, they have the composition not conforming to the present invention. For this reason, it is shown in Table 5 that sample B10, which contains an excess amount of Si, and sample B11, which contains an excess amount of Mg, has an adequate average number density of clusters specified in the present invention, and hence they excel in paint baking hardenability and they prevent increase in yield strength and decrease in formability by room temperature aging; however, they are poor in press formability and hem formability. Sample B12, which contains an excessively small amount of Si, has an excessively small average number density of clusters specified in the present invention. This sample B12 does not increase in yield strength by room temperature aging on account of its low Si content; however, it is low in yield strength after baking and poor in press formability because it is originally poor in strength.

The foregoing results of Examples prove that the composition, structure, and manufacturing condition, which are specified in the present invention, are essential for the samples to have improved paint baking hardenability, to increase in yield strength by room temperature aging, to prevent decrease in formability, and to exhibit good mechanical properties.

TABLE 1

| | | Chemical composition of aluminum alloy sheet (mass %) | | | | | | | |
|---|---|---|---|---|---|---|---|---|---|
| Division | No. | Si | Fe | Cu | Mn | Mg | Cr | Zn | Ti |
| Examples | 1 | 1.0 | 0.2 | — | 0.05 | 0.5 | — | — | 0.01 |
| | 2 | 1.3 | 0.2 | — | — | 0.5 | 0.05 | — | 0.01 |
| | 3 | 1.0 | 0.2 | 0.6 | 0.05 | 0.6 | — | — | 0.01 |
| | 4 | 0.6 | 0.2 | — | 0.05 | 0.8 | — | 0.05 | 0.01 |
| | 5 | 0.8 | 0.2 | 0.3 | — | 0.5 | 0.05 | — | 0.01 |
| Comparative Examples | 6 | 1.6 | 0.2 | — | 0.05 | 0.5 | — | — | 0.01 |
| | 7 | 1.0 | 0.2 | — | 0.05 | 1.5 | — | — | 0.01 |
| | 8 | 0.3 | 0.2 | — | 0.05 | 0.8 | — | — | 0.01 |

TABLE 2

| | | | Duration of retention at room temperature after | Heat treatment | |
|---|---|---|---|---|---|
| Division | Code | Alloy number | solid solution treatment (minutes) | Temperature (° C.) | Cooling rate (° C./hr) |
| Examples | A1 | 1 | 5 | 100 | 1.5 |
| | A2 | 2 | 5 | 100 | 1.5 |
| | A3 | 3 | 5 | 100 | 0.5 |
| | A4 | 4 | 5 | 130 | 3.0 |
| | A5 | 5 | 5 | 100 | 1.5 |
| | A6 | 1 | 5 | 110 | 3.0 |
| | A7 | 3 | 5 | 100 | 2.0 |
| | A8 | 1 | 10 | 120 | 1.5 |
| | A9 | 1 | 5 | 100 | 3.0 |
| Comparative Examples | A10 | 6 | 5 | 100 | 1.5 |
| | A11 | 7 | 5 | 100 | 1.5 |
| | A12 | 8 | 5 | 120 | 1.5 |
| | A13 | 1 | 5 | 140 | 2.0 |
| | A14 | 1 | 5 | 100 | 7.0 |
| | A15 | 1 | 15 | 100 | 1.5 |
| | A16 | 1 | 5 | 80 | 1.0 |

TABLE 3

| | | | | After retention at room temperature for 7 days | | | After retention at room temperature for 100 days | | | | |
|---|---|---|---|---|---|---|---|---|---|---|---|
| Division | Code | Number density of clusters (per μm$^2$) | Crystal grain diameter (μm) | Tensile strength (MPa) | Yield strength (MPa) | Yield strength after paint baking (MPa) | Tensile strength (MPa) | Yield strength (MPa) | Yield strength after paint baking (MPa) | Press formability (mm) | Hem formability |
| Examples | A1 | 9200 | 38 | 245 | 132 | 210 | 250 | 136 | 211 | 28.0 | 1 |
| | A2 | 13200 | 35 | 247 | 135 | 212 | 250 | 137 | 211 | 28.5 | 2 |

TABLE 3-continued

| Division | Code | Number density of clusters (per μm²) | Crystal grain diameter (μm) | After retention at room temperature for 7 days: Tensile strength (MPa) | Yield strength (MPa) | Yield strength after paint baking (MPa) | After retention at room temperature for 100 days: Tensile strength (MPa) | Yield strength (MPa) | Yield strength after paint baking (MPa) | Press formability (mm) | Hem formability |
|---|---|---|---|---|---|---|---|---|---|---|---|
| | A3 | 10400 | 39 | 262 | 140 | 220 | 266 | 143 | 220 | 30.0 | 2 |
| | A4 | 7600 | 38 | 233 | 130 | 195 | 236 | 132 | 198 | 27.5 | 1 |
| | A5 | 8400 | 38 | 250 | 132 | 202 | 255 | 134 | 202 | 29.0 | 1 |
| | A6 | 19600 | 40 | 254 | 143 | 215 | 257 | 145 | 216 | 28.0 | 2 |
| | A7 | 9600 | 35 | 260 | 139 | 219 | 264 | 142 | 220 | 30.0 | 2 |
| | A8 | 23600 | 39 | 253 | 140 | 220 | 256 | 142 | 220 | 27.5 | 2 |
| | A9 | 8400 | 39 | 245 | 131 | 208 | 250 | 135 | 209 | 28.0 | 1 |
| Comparative Examples | A10 | 27200 | 37 | 260 | 145 | 217 | 265 | 149 | 217 | 25.0 | 4 |
| | A11 | 18800 | 38 | 266 | 143 | 220 | 268 | 147 | 221 | 24.5 | 4 |
| | A12 | 2000 | 42 | 172 | 95 | 141 | 174 | 96 | 141 | 23.0 | 1 |
| | A13 | 44800 | 38 | 264 | 151 | 225 | 273 | 160 | 225 | 23.0 | 5 |
| | A14 | 3200 | 34 | 240 | 125 | 198 | 263 | 150 | 201 | 27.5 | 4 |
| | A15 | 1200 | 38 | 265 | 147 | 168 | 267 | 150 | 170 | 28.5 | 4 |
| | A16 | — | 39 | 243 | 129 | 192 | 251 | 147 | 194 | 27.0 | 3 |

TABLE 4

| Division | Code | Alloy number | Soaking heat treatment: Temperature (° C.) | Soaking heat treatment: Cooling rate (° C./hr) | Heating before hot rolling: Heating rate (° C./hr) | Heating before hot rolling: Temperature (° C.) | Duration of retention at room temperature after solid solution treatment (minutes) | Heat treatment: Temperature (° C.) | Heat treatment: Cooling rate (° C./hr) |
|---|---|---|---|---|---|---|---|---|---|
| Examples | A1 | 1 | 540 | 40 | 40 | 400 | 5 | 100 | 1.5 |
| | B2 | 2 | 540 | 40 | 40 | 400 | 5 | 100 | 1.5 |
| | B3 | 3 | 560 | 40 | 40 | 400 | 5 | 100 | 0.5 |
| | B4 | 4 | 560 | 40 | 40 | 400 | 5 | 130 | 3.0 |
| | B5 | 5 | 560 | 40 | 40 | 400 | 5 | 100 | 1.5 |
| | B6 | 1 | 560 | 20 | 40 | 350 | 5 | 110 | 3.0 |
| | B7 | 2 | 540 | 40 | 80 | 450 | 5 | 100 | 2.0 |
| | B8 | 3 | 540 | 20 | 40 | 400 | 10 | 120 | 1.5 |
| | B9 | 1 | 540 | 80 | 40 | 400 | 5 | 100 | 3.0 |
| Comparative Examples | A10 | 6 | 540 | 40 | 40 | 400 | 5 | 100 | 1.5 |
| | B11 | 7 | 540 | 40 | 40 | 400 | 5 | 100 | 1.5 |
| | B12 | 8 | 540 | 40 | 40 | 400 | 5 | 120 | 1.5 |
| | B13 | 1 | 540 | 40 | 40 | 400 | 5 | 140 | 2.0 |
| | B14 | 1 | 540 | 40 | 40 | 400 | 5 | 100 | 7.0 |
| | B15 | 1 | 540 | 40 | 40 | 400 | 15 | 100 | 1.5 |
| | B16 | 1 | 540 | 40 | 40 | 400 | 5 | 80 | 1.0 |
| | B17 | 1 | 540 | 150 | 150 | 400 | 5 | 100 | 1.5 |
| | B18 | 1 | 540 | 10 | 10 | 400 | 5 | 100 | 1.0 |

TABLE 5

| Division | Code | Number density of clusters (per μm²) | Mg—Si particles: Maximum diameter (μm) | Mg—Si particles: Number density (per mm²) | Crystal grain diameter (μm) | After retention at room temperature for 7 days: Tensile strength MPa | Yield strength MPa | Proof stress after paint baking MPa | After retention at room temperature for 100 days: Tensile strength MPa | Yield strength MPa | Yield strength after paint baking MPa | Press formability (mm) | Hem formability |
|---|---|---|---|---|---|---|---|---|---|---|---|---|---|
| Examples | B1 | 5200 | 11 | 173 | 26 | 212 | 104 | 193 | 214 | 107 | 193 | 27.5 | 1 |
| | B2 | 6400 | 17 | 327 | 25 | 217 | 105 | 195 | 220 | 110 | 197 | 27.5 | 1 |
| | B3 | 5600 | 13 | 165 | 28 | 230 | 116 | 202 | 234 | 118 | 203 | 29.0 | 1 |
| | B4 | 4400 | 10 | 128 | 28 | 205 | 103 | 182 | 210 | 107 | 182 | 27.0 | 1 |
| | B5 | 4800 | 11 | 152 | 27 | 228 | 110 | 191 | 232 | 112 | 191 | 28.5 | 1 |

TABLE 5-continued

| | | | | | | After retention at room temperature for 7 days | | | After retention at room temperature for 100 days | | | | |
|---|---|---|---|---|---|---|---|---|---|---|---|---|---|
| | | Number density | Mg—Si particles | | | | | Proof stress | | | Yield strength | | |
| Division | Code | of clusters (per $\mu m^2$) | Maximum diameter (μm) | Number density (per $mm^2$) | Crystal grain diameter (μm) | Tensile strength MPa | Yield strength MPa | after paint baking MPa | Tensile strength MPa | Yield strength MPa | after paint baking MPa | Press formability (mm) | Hem formability |
| | B6 | 6800 | 18 | 356 | 29 | 230 | 119 | 205 | 235 | 133 | 206 | 27.0 | 1 |
| | B7 | 5200 | 18 | 299 | 26 | 222 | 116 | 200 | 228 | 119 | 200 | 28.5 | 1 |
| | B8 | 7200 | 17 | 193 | 28 | 239 | 121 | 203 | 245 | 125 | 203 | 27.0 | 1 |
| | B9 | 4400 | 10 | 121 | 28 | 238 | 120 | 199 | 243 | 124 | 200 | 27.5 | 1 |
| Comparative | B10 | 7200 | 29 | 326 | 30 | 240 | 137 | 205 | 246 | 142 | 208 | 24.0 | 3 |
| Examples | B11 | 6800 | 25 | 294 | 29 | 248 | 137 | 204 | 251 | 143 | 206 | 23.0 | 3 |
| | B12 | 2400 | 11 | 43 | 38 | 150 | 73 | 113 | 152 | 74 | 113 | 21.5 | 1 |
| | B13 | 6800 | 12 | 207 | 27 | 238 | 139 | 210 | 249 | 151 | 215 | 21.5 | 4 |
| | B14 | 2800 | 11 | 157 | 30 | 213 | 107 | 181 | 241 | 134 | 185 | 25.5 | 3 |
| | B15 | 400 | 13 | 181 | 29 | 220 | 116 | 141 | 223 | 116 | 142 | 26.0 | 1 |
| | B16 | 400 | 11 | 212 | 29 | 207 | 100 | 165 | 235 | 122 | 165 | 25.0 | 2 |
| | B17 | 400 | 6 | 23 | 40 | 249 | 135 | 210 | 255 | 138 | 210 | 27.5 | 2 |
| | B18 | 400 | 27 | 410 | 25 | 179 | 88 | 137 | 184 | 90 | 139 | 23.0 | 1 |

<106>

The present invention provides a 6000-series aluminum alloy sheet and a method for production thereof, the former excelling in paint baking hardenability and being invulnerable to room temperature aging after storage for a comparatively long period of 1 to 4 months. The aluminum alloy sheet will find use for parts of automobiles, ships, home appliances, and buildings.

What is claimed is:

1. An Al—Mg—Si aluminum alloy sheet:

comprising an Al—Mg—Si alloy having the following composition: 0.4-1.0 mass % of Mg, 1.0-1.5 mass % of Si, 0.01-0.15 mass % of Mn, and 0.001-1.0 mass % of Cu, with the remainder being aluminum and inevitable impurities, and having a metallographic structure at the center of its thickness which is observed under a transmission electron microscope of 1,000,000 magnifications, wherein the bright field image contains clusters that appear as dark contrast images and each of the clusters is an aggregate of atoms, and wherein the clusters having an equivalent circle diameter from 1 to 5 nm account for 4000-30000/$\mu m^2$ in terms of an average number density, wherein the Al—Mg—Si aluminum alloy sheet is produced by the following method:

preparing an ingot of the Al—Mg—Si aluminum alloy, subjecting the ingot to solution heat treatment and subsequent hot rolling, subjecting the resulting hot-rolled sheet to cold rolling, subjecting the cold-rolled sheet to solid solution treatment and subsequent quenching down to room temperature, subjecting the cooled sheet to preliminary aging treatment, wherein the preliminary aging treatment is reheating at a reheating temperature of 90-130° C. within 10 minutes after cooling, and subjecting the reheated sheet to heat treatment during which the reheated sheet is cooled from the reheating temperature at an average cooling rate of 0.5-5° C./hr over a period of 3 hours or longer.

2. The aluminum alloy sheet as defined in claim 1, having a metallographic structure at the center of its thickness which is observed under a scanning electron microscope of 500 magnifications, wherein Mg—Si particles which have the maximum equivalent circle diameter smaller than 15 μm are present, and Mg—Si particles having an equivalent circle diameter from 2 μm to 15 μM account for 100/$mm^2$ or more in terms of an average number density.

3. The aluminum alloy sheet as defined in claim 2, wherein the crystal grain has a diameter no larger than 35 μm.

4. The aluminum alloy sheet as defined in claim 2, wherein a ratio Si/Mg of a content of Si and a content of Mg is no smaller than 1.0 by mass.

5. A method for producing the aluminum alloy sheet according to claim 1, the method comprising:

preparing an ingot of an Al—Mg—Si aluminum alloy having the following composition: 0.4-1.0 mass % of Mg, 1.0-1.5 mass % of Si, 0.01-0.15 mass % of Mn, and 0.001-1.0 mass % of Cu, with the remainder being aluminum and inevitable impurities, subjecting the ingot to solution heat treatment and subsequent hot rolling, subjecting the resulting hot-rolled sheet to cold rolling, subjecting the cold-rolled sheet to solid solution treatment and subsequent quenching down to room temperature, subjecting the cooled sheet to preliminary aging treatment wherein the preliminary aging treatment is reheating at a reheating temperature of 90-130° C. within 10 minutes after cooling, and subjecting the reheated sheet to heat treatment during which the reheated sheet is cooled from the reheating temperature at an average cooling rate of 0.5-5° C./hr over a period of 3 hours or longer.

6. The method for producing the aluminum alloy sheet according to claim 5, further comprising solution heat treatment of the ingot for 4 hours or longer at a temperature of 500° C. or higher and the melting point or lower, thereby obtaining a soaked ingot, cooling temporarily the soaked ingot to room temperature at an average cooling rate of 20-100° C./hr while it is at 300° C. to 500° C., reheating the cooled ingot up to 350-450° C. at an average heating rate of 20-100° C./hr, and hot rolling the reheated ingot at this temperature.

7. The aluminum alloy sheet as defined in claim 2, comprising 0.6-1.0 mass % of Cu.

8. The aluminum alloy sheet as defined in claim 1, wherein the method of producing the aluminum alloy sheet further comprises:

solution heat treatment of the ingot for 4 hours or longer at a temperature of 500° C. or higher and the melting point or lower, thereby obtaining a soaked ingot, cooling temporarily the soaked ingot to room temperature at an average cooling rate of 20-100° C./hr while it is at 300° C. to 500° C., reheating the cooled ingot up to 350-450° C. at an average heating rate of 20-100° C./hr, and hot rolling the reheated ingot at this temperature.

9. The aluminum alloy sheet as defined in claim 1, wherein the reheating temperature is from 100 to 120° C.

* * * * *